US010053936B2

(12) United States Patent
Herod et al.

(10) Patent No.: US 10,053,936 B2
(45) Date of Patent: Aug. 21, 2018

(54) THERMAL COMPENSATING TUBING ANCHOR FOR A PUMPJACK WELL

(71) Applicant: Tejas Research & Engineering, LLC, The Woodlands, TX (US)

(72) Inventors: Sam Herod, Conroe, TX (US); Robert Henschel, The Woodlands, TX (US); Thomas G. Hill, Jr., Conroe, TX (US)

(73) Assignee: Tejas Research & Engineering, LLC, The Woodlands, TX (US)

( * ) Notice: Subject to any disclaimer, the term of this patent is extended or adjusted under 35 U.S.C. 154(b) by 279 days.

(21) Appl. No.: 14/961,723

(22) Filed: Dec. 7, 2015

(65) Prior Publication Data

US 2016/0084026 A1 Mar. 24, 2016

(51) Int. Cl.
*E21B 33/129* (2006.01)
*E21B 23/01* (2006.01)
*E21B 43/12* (2006.01)

(52) U.S. Cl.
CPC ..... *E21B 23/01* (2013.01); *E21B 43/127* (2013.01)

(58) Field of Classification Search
CPC ..... F04B 47/00; E21B 17/07; E21B 33/129; E21B 43/126
See application file for complete search history.

(56) References Cited

U.S. PATENT DOCUMENTS

| | | | | | |
|---|---|---|---|---|---|
| 2,174,121 | A * | 9/1939 | Collins | F04B 47/00 | 166/105 |
| 3,376,826 | A * | 4/1968 | Crowe | F04B 47/00 | 417/554 |
| 3,399,623 | A * | 9/1968 | Creed | E21B 43/00 | 166/302 |
| 3,543,850 | A * | 12/1970 | Stout | E21B 36/006 | 166/62 |
| 4,258,792 | A * | 3/1981 | Restarick | E21B 17/07 | 166/242.1 |
| 4,393,931 | A * | 7/1983 | Muse | E21B 33/1295 | 166/175 |
| 6,206,101 | B1 * | 3/2001 | Bakke | E21B 23/04 | 166/301 |
| 8,336,625 | B2 * | 12/2012 | Mullen | E21B 34/12 | 166/305.1 |
| 8,794,337 | B2 * | 8/2014 | Thomas | E21B 17/003 | 166/242.6 |
| 2004/0055761 | A1 * | 3/2004 | Eslinger | E21B 17/07 | 166/387 |

* cited by examiner

*Primary Examiner* — Kipp C Wallace
(74) *Attorney, Agent, or Firm* — Tumey L.L.P.

(57) ABSTRACT

Apparatus and method for limiting the expansion and contraction of a production tubular within a pumpjack oil well includes an anchor having a hydraulic dampening chamber and an expansion joint. A piston is attached to the tubular and position within the hydraulic dampening chamber so that axial expansion and contraction of the tubular caused by thermal and loading forces is resisted by the constrained movement of the piston within the hydraulic chamber.

7 Claims, 6 Drawing Sheets

THERMAL COMPENSATING TUBING ANCHOR FOR A PUMPJACK WELL

BACKGROUND OF THE INVENTION

Field of the Invention

This application is directed to an anchor system for production tubing in a pumpjack type oil well. The anchor stabilizes the tubing during operation of the well as explained below.

Description of Related Arts Invention

A pumpjack is often used with a "rod pumping system" and is used to mechanically lift liquid out of the well if there is not enough bottom hole pressure for the liquid to flow all the way to the surface. The arrangement is commonly used for onshore wells to enhance or increase production. Pumpjacks are common in oil-rich areas. Depending on the size of the pump, it generally produces 5 to 40 liters of liquid at each stroke. Often this is an emulsion of crude oil and water. Pump size is also determined by the depth and weight of the oil to remove, with deeper extraction requiring more power to move the increased weight of the discharge column (discharge head). A pumpjack converts the rotary mechanism of a motor to a vertical reciprocating motion to drive the pump shaft, and is exhibited in the characteristic nodding motion. The engineering term for this type of mechanism is a walking beam. The prime mover of the pumpjack runs a set of pulleys to the transmission which drives a pair of cranks, generally with counterweights on them to assist the motor in lifting the heavy string rods. The cranks raise and lower one end to assist the motor in lifting the heavy string rods. The cranks raise and lower one end of an I-beam which is free to move on an A-frame. On the other end of the beam, there is a curved metal box called a horse head or donkey head. A cable made of steel or fiberglass, called a bridle, connects the horse head to a polished rod, a piston that passes through a stuffing box. The polished rod has a close fit to the stuffing box, letting it move in and out of the production tubing without fluid escaping. The bridle follows the curve of the horse head as it lowers and raise to create a nearly vertical stroke. The polished rod is connected to a long string of rods called sucker rods, which run through the tubing to the down-hole pump, usually positioned near the bottom of the well. At the bottom of the tubing is the down-hole pump comprised of two assemblies. This pump has two ball check valves: the first is a stationary valve at bottom called the standing valve. The second is in valve on the piston connected to the bottom of the sucker rods that travels up and down as the rods reciprocate, known as the travelling valve. Each of these valves permits wellbore liquids to move upward toward the surface but prohibits fluids from moving back downhole. Reservoir fluid enters from the formation into the bottom of the borehole through perforations that have been made through the casing and cement. When the rods at the pump end are traveling up, the traveling valve is closed and the standing valve is open due to the drop pressure in the pump barrel. Consequently, the pump barrel fills with the fluid from the formation as the traveling piston lift the previous contents of the barrel upwards. When the rods begin pushing down, the traveling valve opens and the standing valve closes due to an increase in pressure in the pump barrel. The traveling valve drops through the fluid in the barrel. The piston then reaches the end of its stroke and begins its path upward again, repeating the process. The number of strokes per time unit defines the maximum flow rate from the well. However each application affects the fill efficiency of this volume, which in turn, affects the actual flow rate of fluids from the well. Affecting efficiency is the elasticity of the tubing, wherein the tubing "stretches" axially in tension during down stokes and "compresses" or buckles axially during upstrokes. When "heavy oil" is produced by rod pumped wells often steam is injected in the well to reduce the viscosity of the hydrocarbons, enabling it to flow more readily into the wellbore. Cycling between steam injection periods and production periods, thermal effects cause the steel tubing to either expand lengthwise with heat or contract as the well cools, which also affects the efficiency of the well. A well-known tubing anchor that serves to stabilizing the tubing may be employed, but the thermal effects of steam injection cause very high alternating compression and tension loads on the tubing anchor also causing bucking and tension in the production tubing further decreasing pumping efficiency and often leading to premature failure of the tubing anchor. The great temperature variations imposed by steam injection prohibit use of any known tubing anchor.

Consequently, there is a need for an anchoring system that prevents a wide variation of the tubing movement caused by up and down strokes of the sucher rods, and the expansion and contraction of the tubing during heating and cooling cycles both in an axial and radical direction.

BRIEF SUMMARY OF SOME OF THE PREFERRED EMBODIMENTS

These and other needs in the art are addressed by an anchor that acts as a thermal expansion joint while it dampens the axial expansion and contraction of the production tubing during pump operation. An embodiment of the invention includes an anchor having an outer housing secured to the casing and includes an annular hydraulic chamber. A piston is attached to the production tubing and is located within the hydraulic chamber so as to retard and dampen axial forces of the tubing. The piston includes on its outer surface a tortuous flow path formed by a plurality of annular rings and or pathways.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
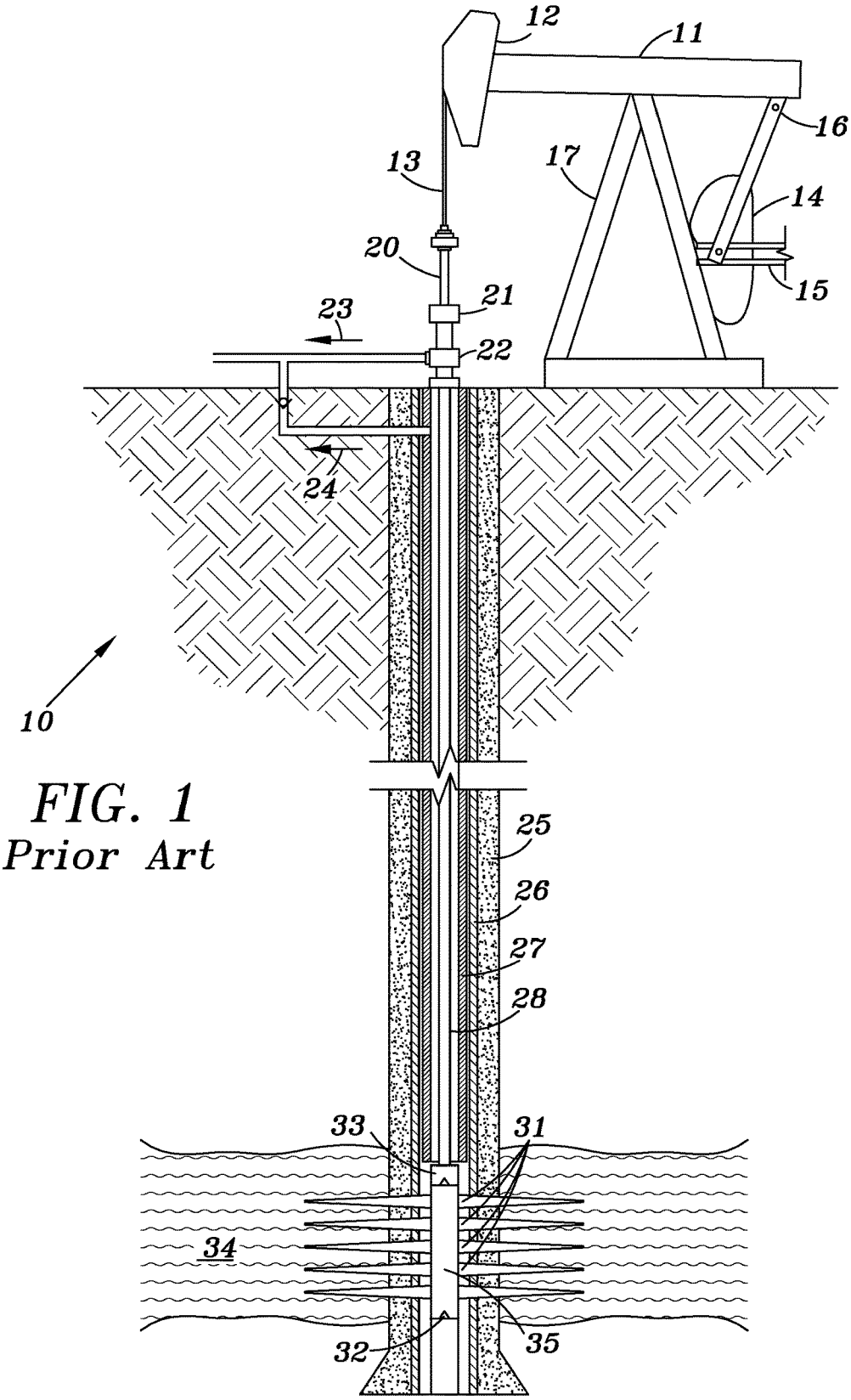
FIG. 1 Prior Art
FIG. 1 is a schematic of a conventional pumpjack oil well.

A conventional pumpjack well 10 is shown in FIG. 1 and includes a walking beam 11 having a horse head 12 and one or more cables 13 attached to a polished rod 20. A mechanism for pivoting the walking beam about support 17 includes pitman arm 16, a crank 15 and a counter weight 14. A prime mover and transmission mechanism not shown drives crank 15 in a known manner.

The well includes a stuffing box 21 through which polished rod 20 reciprocates. Polished rod passes through a tee 22 and is connected to a sucker rod or rods 28. Conduits 23 and 24 are provided for produced gas and oil respectively.

The well further includes a casing 26, cement 25 surrounding the casing, and production tubing 27. The lower end of the casing and cement is perforated at 31 in the production zone 34 to allow fluids to enter pump chamber 35.

A standing valve 32 is fixed at a lower portion of the tubing and a traveling valve 33 is attached to the lower end of the reciprocating sucker rod thereby forming a pump as is known in the art.

Figure 2:
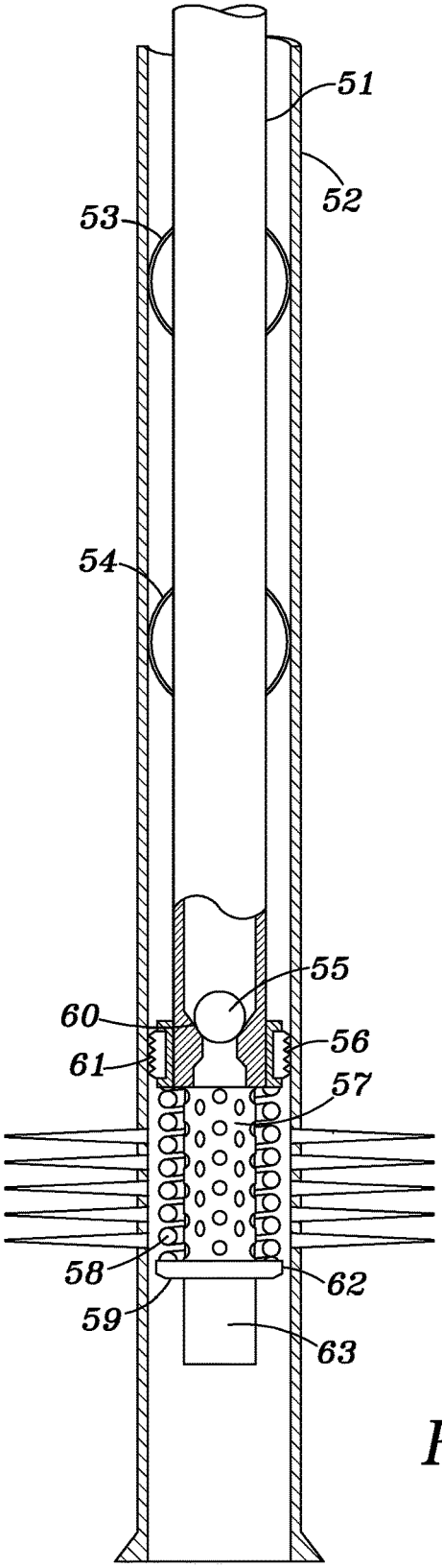
FIG. 2 is a cross sectional view of a first embodiment of an anchoring system according to the invention.

According to a first embodiment of the invention as shown in FIG. 2, the anchor 56 for the tubing 51 includes a plurality of slips 61 which are set in the well at a desired depth.

Pressure from the surface applied against the traveling valve by a ball 55 and seat 60 sets the anchor 56 to the casing 52.

A compression spring 58 is positioned between anchor 56 and a flange 62 on the production tubing to keep constant tension on the tubing thereby arresting excess axial movement of the tubing caused by the reciprocating movement of the downhole pump by asserting a compression force against the tubing anchor and the flange 62 affixed to tubing 51 at a lower end 63 of the tubing. A plurality of centralizers 53, 54 may also be attached to tubing 51 to stabilize the tubing within the causing 52.

A second embodiment of an anchoring system is shown in FIGS. 3-7. The anchor includes an outer housing having a first uphole portion 73, and a downhole portion 83 which are fixedly connected to each other at 99.

A closure cap 72 is positioned between housing portion 73 and a first section 69 of production tubing. A dampening piston 75 is attached to the first section of tubing 69 and a second section 70 of the production tubing. Dampening piston 75 is free to float within an hydraulic chamber 79 which is filled with hydraulic fluid. Two groups of rings 76, 77 are positioned on the outer surface of dampening piston 75 as best shown in FIG. 4 to form a tortuous resistance flow path for the hydraulic fluid from one side of the piston to the other as the piston shuttles in the hydraulic chamber 79.

Figure 4:
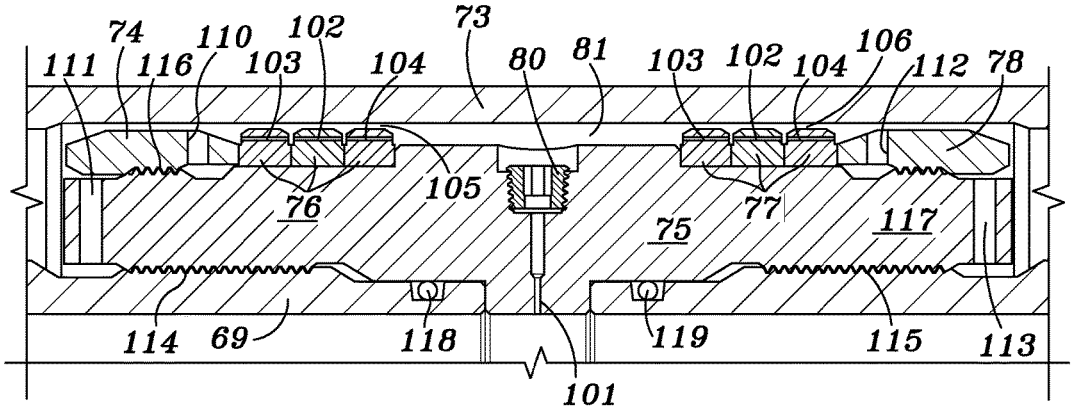
FIG. 4 is an enlarged view taken from FIG. 3.

FIG. 4 is an enlarged view of the piston 75. Piston 75 is threadly attached to tubing 69 and 70 at 114 and 115 respectively. Annular seals 118 and 119 may be positioned between the piston and tubing 69 and 70. A first set of three rings 76 are attached to a first end of the piston by end cap 74 which is threaded on piston 75 as shown at 116. A passageway 110 is provided in end cap 74. Rings 76 are spaced from housing 73 is to form a tortuous path 105. Additionally, one or more passageways 102, 103, and 104 are formed in the rings to provide additional flow paths.

In similar manner, a second end cap 78 is threaded on piston 75 at a second end as shown at 117 and thereby secure a second set of rings 77 on the piston.

Rings 77 are also spaced from housing 73 thereby forming a torturous path 106. Also one or more passageways 102, 103, 104 may be provided in the rings to allow fluid flow through the rings. End cap 78 is also provided with a passageway 172. A flow passage 111 is provided at one end of piston 75 and a second flow passage is provided at the second end of piston 75. A pair of seals 118 and 119 may be positioned between tubulars 69 and 70 and piston 75 as shown in FIG. 4.

Figure 5:
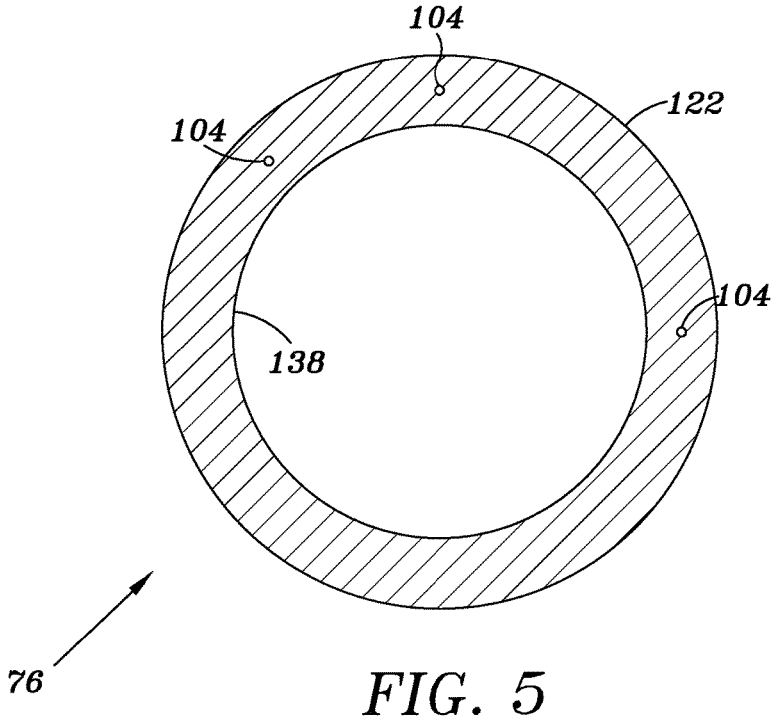
FIG. 5 is a cross-sectional view of one of the ring members.

FIG. 5 illustrates a front view of one of the ring members 76 and 77. The inner surface 138 of ring member 76 is circular and sits on the circular outer surface of piston 75. The outer surface of ring members 76 or 77 are circular with a tight clearance to the inside diameter of housing 73. The outer surface may also include a channel or series of restricted flow paths.

Thus a plurality of tortuous paths 106 are formed around the periphery of the rings allowing fluid to flow along piston 75 in a controlled manner. Additionally one or more flow passages 104 may be formed through the rings for control purposes.

A slip housing 86 surrounds downstream anchor housing 83. A first annular piston 88 is positioned between slip housing 86 and downhole anchor housing 83.

A second annular piston 89 is also positioned between slip housing 86 and downhole anchor housing 83 and includes an inclined surface 90 which is adapted to move slips 68 outwardly to engage the inner surface of the well's casing to thereby fixedly secure the anchor within the casing with the tubing 69, 70 temporally attached to the anchor via shear pins 94 between tubing section 95 which is attached to tubing 70 and portion 93 of the anchor housing. A plurality of shear pins 87 connect slip housing 86 to the second piston 89.

Figure 6:
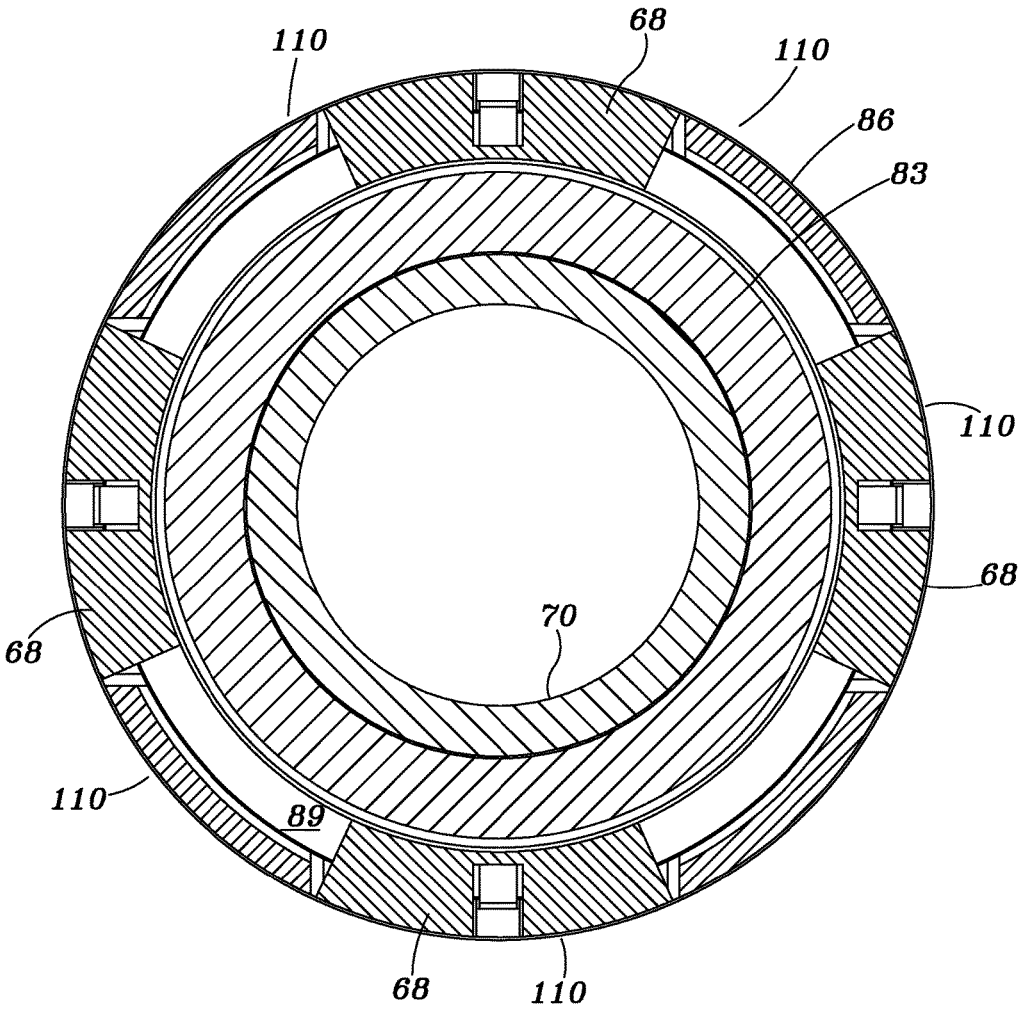
FIG. 6 is a cross sectional view taken along line 6-6 of FIG. 3.

FIG. 6 illustrates the details of the anchoring slips 68 that are spaced around the periphery of slip housing 86 and anchor housing 83. Annular moveable piston 89 forces slips 68 outwardly through radically spaced openings 110 in housing 86 in a known manner.

Figure 3:
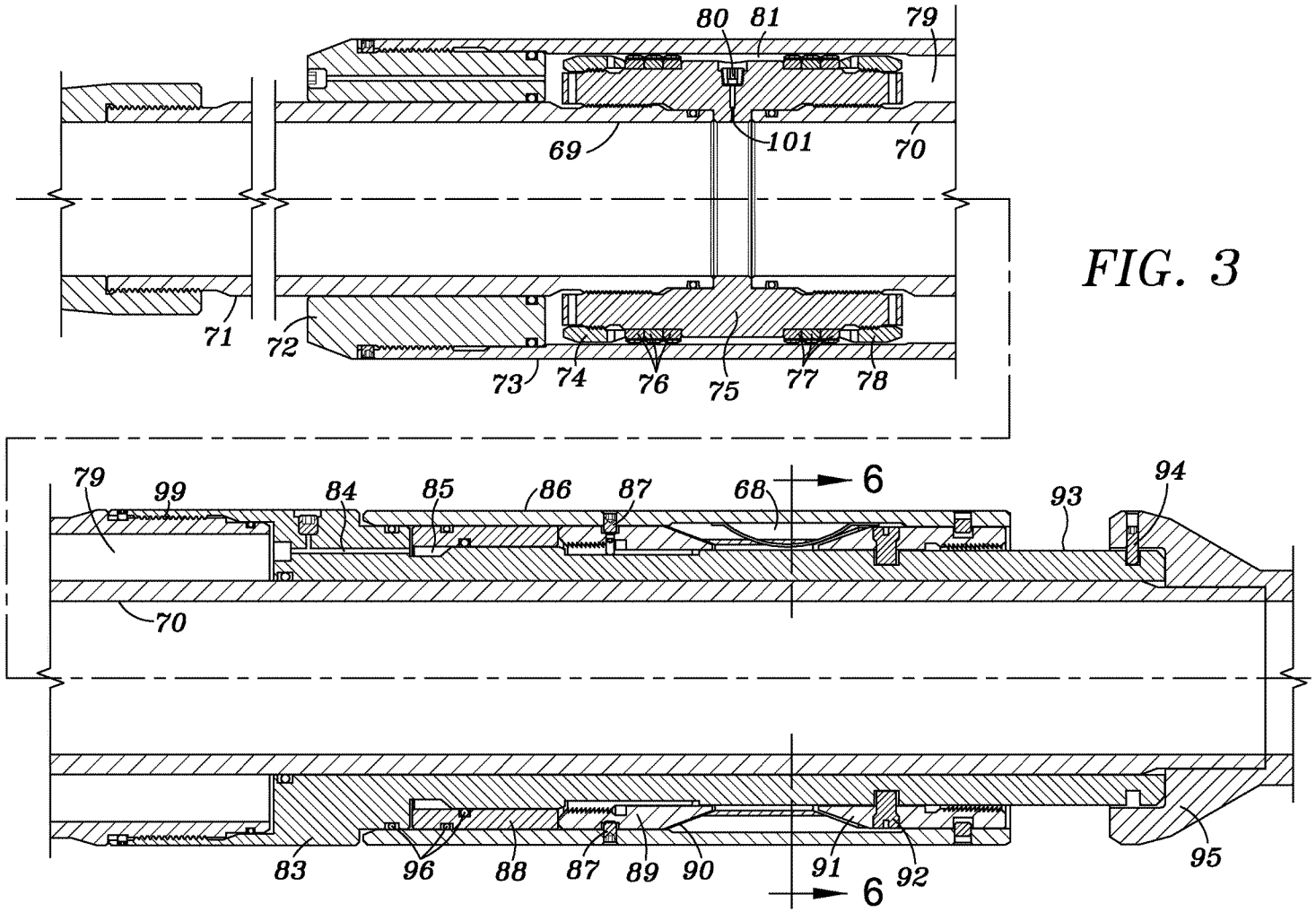
FIG. 3 is a cross sectional view of an anchor according to a second embodiment of the invention.

In order to set the anchor within the well, the anchor with tubular sections 69, 70, and 95 is lowered to the desired position within the well with the tool configured as shown in FIG. 3. Fluid under pressure is then pumped down through tubular 69 and enters hydraulic chamber 79 through passageway 101 and rupture disc 80 and tortuous pathway 81. From there fluid under pressure flows through passageway 84 and enters pressure chamber 85 acting on piston 88 causing shear pins 87 to break thereby allowing first and second pistons 88 and 89 to move downhole to the right as shown in FIG. 3. This causes inclined surface 90 to push slips 68 outwardly to grip the inner surface of the casing not shown, thus anchoring the system to the casing.

As the temperature within the well increases, tubing 69, 70, and 95 will expand thereby shearing pins 94. At this point the production tubing string 69, 70, and 95 along with dampening piston 75 is free to move within the anchor subject to the dampening effect of piston 75 moving within hydraulic chamber 79.

The anchor can be retrieved from the well by pulling upward on the tubing.

This will shear pins 92 which are positioned between downhole housing 93 and a lower cone member 91. This allows slips 68 to fall back into slip housing 86 thereby releasing the slips 68 from engagement with the casing.

Figure 7:
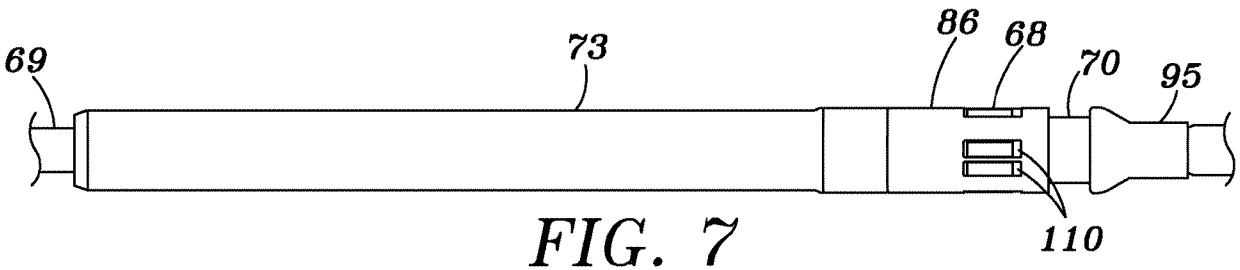
FIG. 7 is a schematic showing of the anchor system of FIGS. 3-6 in a run in position.
Figure 8:
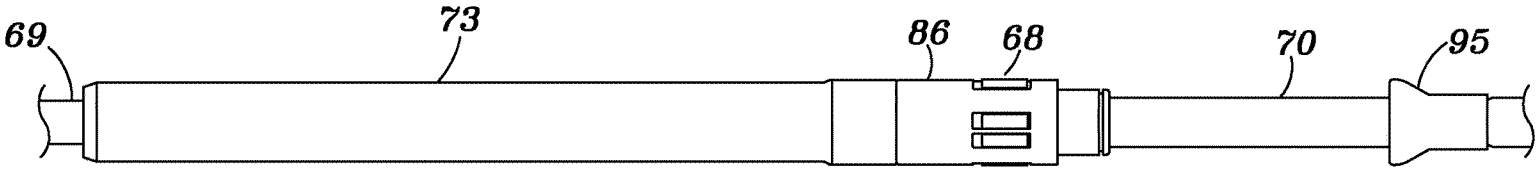
FIG. 8 is a schematic showing of the anchor system of FIGS. 3-6 in a fully set expanded position.
Figure 9:
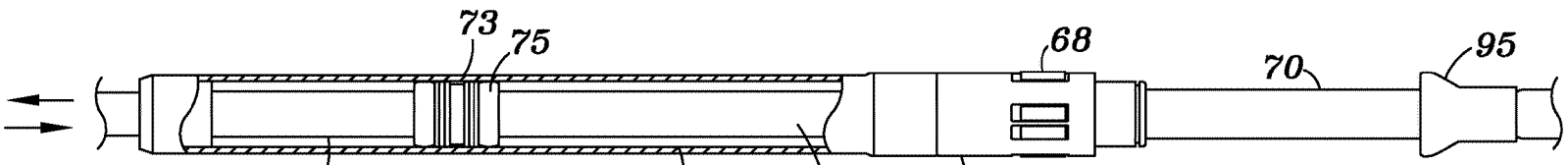
FIG. 9 is a schematic showing of the anchor system of FIGS. 3-6 in an operating expanded position.

FIGS. 7-9 schematically illustrates the functionality of an embodiment of the invention.

FIG. 7 shows the tubulars 69, 70, and 95 positioned within anchor housing 73 and 86 in the run in position. Anchor housing 86 includes slips 68 which anchor the system in the well casing, not shown.

FIG. 8 depicts the anchor being set within the casing by slips 68 and also illustrates the thermal expansion of tubular 70.

FIG. 9 shows the dampening aspect of the invention as the tubular tends to move up and down due to the stroke of the sucher rod of the pump. At this point, the up and down movement of the tubular is dampened due to piston 75 which is attached to the tubular 70 and located within the hydraulic chamber 79 as explained above.

Although the present invention and its advantages have been described in detail, it should be understood that various changes, substitutions and alterations may be made herein without departing from the spirit and scope of the invention as defined by the appended claims.

What is claimed is:

1. An anchor system for a tubular in a well comprising:

an anchor housing including an uphole portion and a downhole portion, the housing including a hydraulic chamber;

a tubular positioned within the anchor housing and releasably connected to the anchor housing; and a piston fixedly mounted on an exterior surface of the tubular, the piston positioned within the hydraulic chamber and adapted to move axially within the chamber after the tubular has been released from the anchor housing;

a plurality of slips are mounted within the anchor housing, the slips being adapted to move radially outwardly to engage the inner wall of casing located in the well to thereby secure the anchor system to the casing;

a slip housing surrounding the downhole portion of the anchor housing, the slips being mounted within the slip housing in a non-deployed position;

wherein the slips are moved releasably outwardly by a conical member under the influence of fluid pressure applied to a second piston positioned within the slip housing.

2. An anchor system as claimed in claim 1 wherein the hydraulic chamber is located within the uphole portion of the anchor housing.

3. An anchor system as claimed in claim 1 wherein the tubular includes a first portion, a second portion, and a third portion releasably attached to the downhole portion of the anchor housing by a plurality of shear pins.

4. An anchor system as claimed in claim 1 wherein the hydraulic chamber is an annular chamber surrounding the tubular and the piston is a annular piston surrounding the tubular.

5. An anchor system as claimed in claim 1 further including a plurality of shear pins connecting the conical member to the slip housing.

6. An anchor system for anchoring a tubular within a well casing comprising:

a) a tubular;

b) a tubular anchor adapted to be rigidly attached to the well casing;

c) an expansion joint between the anchor and the tubular for allowing the tubular to move axially within the tubular anchor after the tubular anchor has been attached to the casing; and d) means for dampening axial movement of the tubular resulting from reciprocating motion of a sucker rod of a pump when the pump is positioned within the well.

7. An anchor system for a tubular in a well comprising:

an anchor housing including an uphole portion and a downhole portion, the housing including a hydraulic chamber;

a tubular positioned within the anchor housing and releasably connected to the anchor housing; and a piston fixedly mounted on an exterior surface of the tubular, the piston positioned within the hydraulic chamber and adapted to move axially within the chamber after the tubular has been released from the anchor housing wherein the piston includes a plurality of torturous paths on an outer surface of the piston, the torturous paths being formed by a plurality of rings surrounding the piston.

* * * * *